United States Patent [19]

Biller et al.

[11] 4,272,751

[45] Jun. 9, 1981

[54] HIGH-VOLTAGE FUSE LINK AND METHOD OF MANUFACTURING SAME

[75] Inventors: Bruce A. Biller; Hiram S. Jackson, Jr., both of Chicago, Ill.

[73] Assignee: S&C Electric Company, Chicago, Ill.

[21] Appl. No.: 51,933

[22] Filed: Jun. 25, 1979

[51] Int. Cl.[3] ..... H01H 69/02; H01H 85/36

[52] U.S. Cl. ..... 337/231; 337/240; 337/252; 337/291; 29/623

[58] Field of Search ..... 337/26, 291, 251-253, 337/413, 231, 234, 240, 193; 29/623, 861, 862, 869, 871, 863, 864; 174/21 R

[56] References Cited

U.S. PATENT DOCUMENTS

| | | | |
|---|---|---|---|
| 2,067,577 | 1/1937 | Mosley et al. | 337/240 |
| 2,151,032 | 3/1939 | Jensen | 29/869 |
| 2,253,720 | 8/1941 | McMahon | 337/251 |
| 2,333,345 | 11/1943 | Steinmayer | 337/252 |
| 3,566,465 | 3/1971 | Weiner | 29/862 |
| 4,038,743 | 8/1977 | Durocher | 29/869 |

*Primary Examiner*—William H. Beha, Jr.
*Attorney, Agent, or Firm*—John D. Kaufmann

[57] ABSTRACT

A fuse link and a method of manufacturing same are disclosed. The fuse link comprises a fusible element extending between an upper terminal and a lower terminal. The lower terminal includes a compressed segment of a multi-strand cable to which the fusible element is attached. In practicing the method of the present invention, a segment of the multi-strand cable is first radially compressed, as by cold-forming, to produce a longitudinal receiving region or pocket indentation for receiving an end of the fusible element. Thereafter, an end of the fusible element is placed into the receiving region. The region is then further compressed and collapsed to secure the fusible element therein by crimping a compressible sleeve previously placed around the fusible element and the cable-segment.

16 Claims, 8 Drawing Figures

FIG. 1
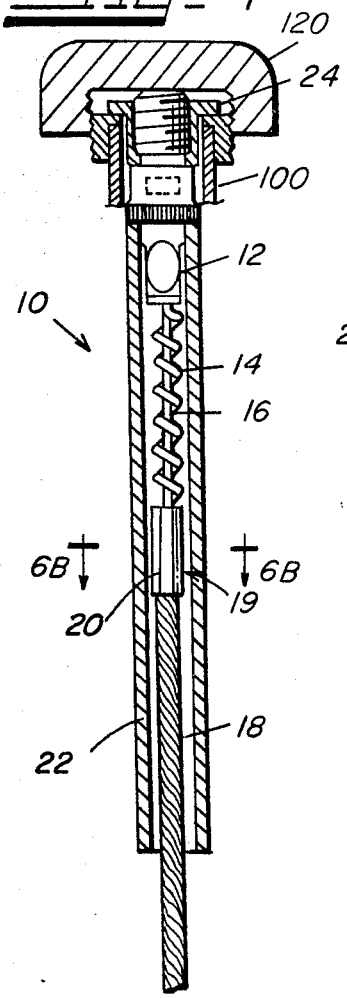
FIG. 2
PRIOR ART
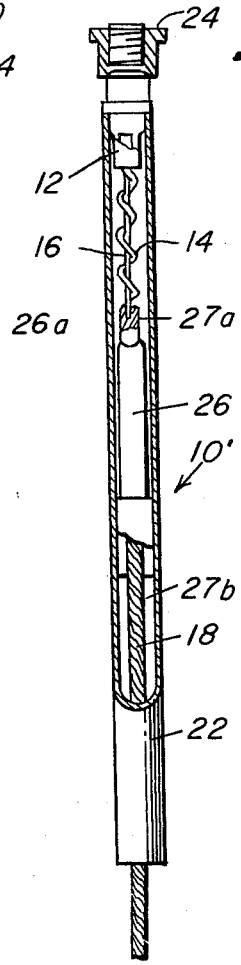
FIG. 3
PRIOR ART
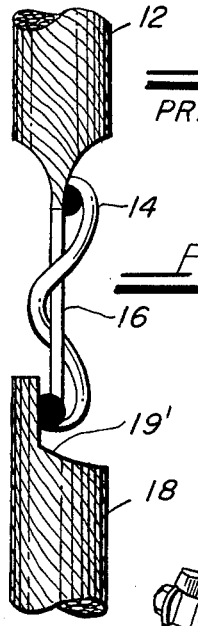
FIG. 4
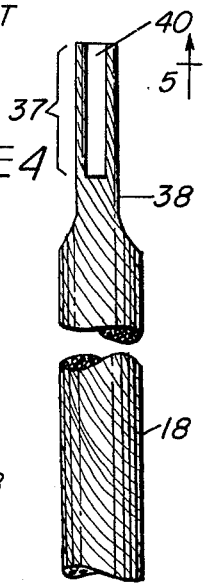
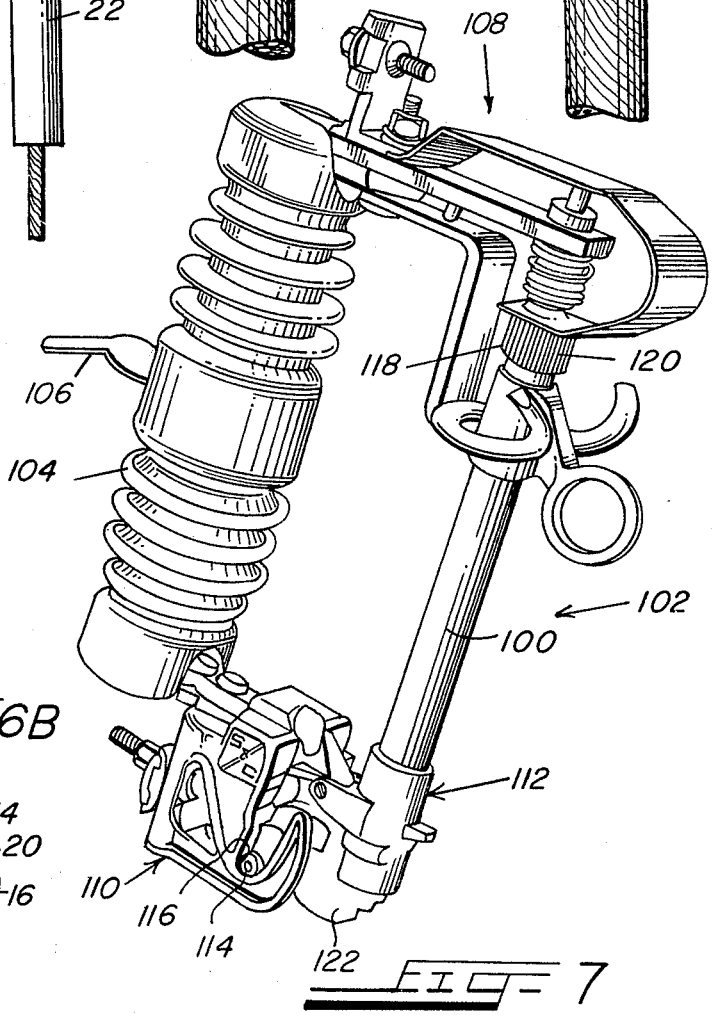
FIG. 5
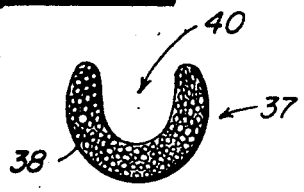
FIG. 6A
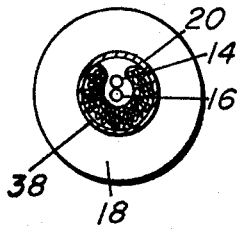
FIG. 6B
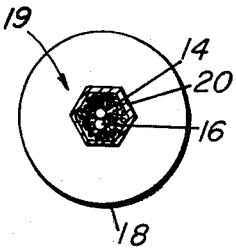
FIG. 7

HIGH-VOLTAGE FUSE LINK AND METHOD OF MANUFACTURING SAME

BACKGROUND OF THE INVENTION

1. Field of the Invention

This invention relates to a circuit interrupting device, and more particularly to a fuse link and a method of manufacturing same by pocket indentation.

2. Description of the prior Art

Prior to the present invention, it has been customary to manufacture fuse links by attaching a fusible element and, where necessary, a strain wire to a rather massive electrically conducting connector, or lower terminal, and thereafter attaching the lower terminal by crimping, brazing, soldering, welding or the like to an electrically multistrand cable. Both of these attaching operations have been performed by providing the lower terminal with holes in opposite ends thereof. The fusible element and strain wire are inserted into one hole and the multi-strand cable is inserted into the other hole and both ends of the connector are thereafter crimped, brazed, soldered or welded. Such fuse links additionally include an upper terminal attached to the fusible element and strain wire, with the upper terminal being suitably adapted for engagement with the end of a fuse tube with which the fuse link is to be used. Prior art manufacturing techniques significantly contribute to the cost of fuse links so produced due to the material cost of the lower terminal and the labor cost associated with its incorporation into the fuse link.

Possibly in order to reduce such production costs, at least one company has manufactured a fuse assembly without the above-mentioned connector or lower terminal. Such fuse assembly, as will be more fully discussed hereinafter, has limitations associated therewith since its method of manufacturing apparently utilizes localized welding, soldering, or brazing techniques to attach both the fusible element and strain wire at one end to the multi-strand cable and at the other end to the upper terminal. Further, this method of manufacture does not readily lend itself to mass production.

In addition to the prior art fuse links and methods of manufacture thereof, as previously discussed, other examples of fuse links may be found in the following United States patents: Nos. 1,833,849, issued to Nichols; 2,090,609, issued to Lemmon, 2,269,960, issued to Triplett; 2,270,225, issued to Steinmayer; 2,292,058, issued to Craig; 2,325,416, issued to McMahon; 2,335,229, issued to Anderson; 2,341,865, issued to Herman; 2,382,602, issued to Brown; 2,586,171, issued to McMahon; 2,705,471, issued to McBride; 3,059,081, issued to Gainer, et al.; 3,118,992, issued to Chabala; 3,152,236, issued to Schultz; 3,275,772, issued to Neff; and 3,471,816, issued to Giegerich.

SUMMARY OF THE INVENTION

According to the present invention, the above-noted and other shortcomings of prior art fuse links and methods of manufacture thereof are overcome by the present invention.

In one aspect of the present invention, the method generally comprises subjecting a segment or short length of an electrically conducting multi-strand cable to sufficient radially directed pressure to compress the cable segment and to mechanically bond or cold form the individual strands of the cable together. A receiving region, such as a pocket indentation, is simultaneously or later formed in the compressed cable segment and ends of a fusible element and a strain wire are placed within this region to form a sub-assembly. A sleeve, placed around the region is then deformed to subject the sub-assembly to additional radially directed pressure to further compress the cable segment, collapsing the pocket to mechanically secure the strain wire and the fusible element ends to the cable segment. Opposite ends of the fusible element and the strain wire may then be attached in a customary manner to the upper terminal.

Deformation of the sleeve may be by a substantially uniform radially directed crimping force which causes the sleeve to be crimped upon and compress the cable length to collapse the pocket and firmly secure the fusible element and strain wire ends to the cable segment. Also, deformation of the sleeve may be effected by radial application of force at pre-determined points on the perimeter of the sleeve to render the sleeve polygonal in shape.

In a further aspect, the present invention contemplates a fuse link made by the above-described method.

These and other aspects of the present invention advantageously provide for the elimination of the massive lower terminal of the prior art and the attendant relatively high electrical resistance associated therewith, and provide a method of manufacture thereof. These and other aspects and advantages will become more apparent by reference to the drawings and to the description of preferred embodiments and alternative embodiments thereof as hereinafter follows.

BRIEF DESCRIPTION OF THE DRAWING

FIG. 1 is a partial cross-sectional, side-elevational view of a novel fuse link manufactured according to the novel method of the present invention;

FIG. 2 is a partial cross-sectional, side-elevational view of a typical prior art fuse link assembly;

FIG. 3 is a partial plan view of another typical prior art fuse link assembly;

FIG. 4 is a top view of a portion of a cable found in the fuse link assembly of FIG. 1 which has undergone radially directed compression, according to the principles of the present invention;

FIG. 5 is a cross-sectional view taken along the lines 5—5 of FIG. 4.

FIGS. 6A and 6B are respectively, before and after cross-sectional views taken along lines 6B—6B of FIG. 1 and including sections of the strain wire and the fusible element placed within the receiving region and surrounded by a sleeve; and FIG. 7 is a partially cut-away view of a fuse cutout containing the fuse link of the present invention.

DETAILED DESCRIPTION OF THE INVENTION

The present invention will be more readily understood by reference to FIG. 1 wherein a fuse link assembly 10, manufactured according to the teachings disclosed herein, is depicted. The fuse link assembly 10 comprises an upper terminal 12 attached at one end thereof by any convenient means to a fusible element 14 and, in some cases, also to an electrically conducting, fusible strain wire 16. The upper terminal 12 may be provided with a void or hole (not shown) in which the element 14 and the strain wire 16 are positioned. The sides of the terminal 12 may then be compressed to crimp the terminal 12 around the element 14 and the wire 16, thereby affecting secure attachment.

Opposite ends of the fusible element 14, and of the strain wire 16 where used, are directly attached, as is more fully described hereinafter, to the end of a multi-strand cable 18, with the point of attachment 19 acting as a lower terminal of the fuse link assembly 10. The multi-strand cable 18 may be any commercially available multi-strand cable such as, for example, extra flexible rope-lay stranded copper conductors or bunch-stranded members (both tinned or untinned) sold by Camden Wire Co., Inc. and Flexo Wire Division of Copperweld Steel Co. The assembly 10 is preferably provided with a sleeve 20 which is suitably sized to enclose the ends of the cable 18, the fusible element 14 and the strain wire 16.

The fuse link assembly 10 is typically provided with a covering sheath 22 positioned along the cable 18 and frictionally engaged with, or adhesively bonded or otherwise attached to, a portion of the upper terminal 12. As shown in FIG. 1, the covering sheath 22 surrounds the upper terminal 12, the fusible element 14, the strain wire 16, the point of attachment 19 and the sleeve 20. The sheath 22 may be made of compressed, wrapped paper or any other suitable electrically nonconducting material impregnated, coated, or lined with one or more layers of ablative, arc-extinguishing material.

As one skilled in the art will appreciate, the strain wire 16 may not be necessary. Specifically, the fusible element 14 is oftentimes made from materials, such as, for example, silver, tin alloy, or a combination of silver and tin alloy, which are mechanically weak. If sufficient tension is applied to the fuse link assembly 10, such tension may break or pull apart fusible elements 14 made of these mechanically weak materials. In these cases, the strain wire 16 prevents the pulling apart of the fusible element 14 by tension applied to the cable 18.

The upper terminal 12 may be provided, at one end thereof, with an attachment means, such as, for example, a flange 24, as shown in FIG. 1, for engagement with the top of a fuse tube 100 of a cutout 102 or the like with which the assembly 10 is used, as seen in FIGS. 1 and 7.

Referring to FIG. 7, the cutout 102 may include an insulator 104 mountable to a support structure (not shown) by a mounting stud 106. The top of the insulator 104 supports an upper mounting assembly 108, connectable to one side of a circuit, and a lower mounting assembly 110, connectable to the other side of the circuit. A lower end fitting 112 on the fuse tube 100 has a trunnion 114 which mates with a trunnion pocket 116 formed in the assembly 110, to permit pivoting of the fuse tube 100. An upper end fitting 118 on the fuse tube 100 includes a cap 120 (see also FIG. 1) threaded onto the tube 100 to trap the flange 24 between the cap 120 and the tube 100. The upper fitting 118 is latched into the position shown by the assembly 108. The cable 18 runs down through the tube 100 and is held by a spring-loaded flipper 122 which tensions the cable 18 and the strain wire 16. If a sufficiently high overcurrent occurs in the circuit for a sufficient length of time, the fusible element 14 and the strain wire 16 melt. The flipper 122 initiates movement of the cable 18, including the lower terminal 19, out of, first, the sheath 22 and, then, the tube 100.

As soon as the fusible element 14 and strain wire 16 melt, an arc is formed between the terminals 12 and 19. Movement of the terminal 19 elongates the arc, which also interacts with the sheath 22 and the tube 100 to cause the rapid evolution of turbulent, cooling, deionizing gas. The gas pressure thereby produced ultimately "overcomes" the force of the flipper 122 and expels the lower terminal 19 and the cable 18 from the tube 100 in piston-cylinder fashion. Arc elongation and the action of the evolved gas extinguish the arc, as is well known.

When tension applied to the cable 18 by the flipper 122 is relieved by the above-described action, the assembly 108 releases the fitting 118 permitting the fuse tube 100 to rotate downwardly to a "drop-out" position, via the trunnion 114 and pocket 116. This gives a visual indication of cutout operation and establishes an air gap between the assemblies 108 and 110 sufficient to prevent subsequent current conduction therebetween. This "drop-out" action is achieved by various spring members in the assembly 108 and by the relationships among the flipper 122, the trunnion 114, the trunnion pocket 116 and the fitting 112, as is well known.

Referring now to FIG. 2, a typical fuse link 10' of the prior art is depicted. Components of FIG. 2 which are similar to those of FIG. 1 are given the same reference numerals. The prior art fuse assembly of FIG. 2, which is manufactured and sold by the S&C Electric Company, Chicago, Ill., the assignee of the present invention, is provided with a relative massive connector or lower terminal 26 which electrically and mechanically connects the fusible element 14 and the strain wire 16 to the cable 18. The connector 26 is a copper alloy rod. In order to join the fusible element 14 and the strain wire 16 to the connector 26, the connector 26 is generally provided, at end **26*a*, with a hole sized to receive the ends of the fusible element 14 and the strain wire 16. The opposite end 26*b* of the connector 26 is also provided with a hole 27*b* appropriately sized to receive the cable 18**.

In manufacturing the fuse link 10' of the prior art, as depicted in FIG. 2, the fusible element 14 and strain wire 16 are positioned within the hole of the end **26*a* and the cable 18 is placed within the hole or 27*b* of the end 26*b*. Thereafter, the ends 26*a* and 26*b* of the connector 26 are subjected to an inwardly directed radial force, either simultaneously or consecutively, to deform the ends 26*a* and 26*b* and to compress the fusible element 14, the strain wire 16, and the cable 18 therewithin. This procedure, and the accompanying fuse link 10'** produced thereby, result in relatively high significant material and labor costs associated therewith.

Another prior art fuse link 10'' is depicted in FIG. 3, in which components similar to those of FIG. 1 are given the same reference numerals. This fuse link 10'', which is manufactured by the General Electric Company, contains the fusible element 14 and the strain wire 16 connected at one end thereof to the upper terminal 12 and at the other ends thereof to the cable 18. The connection of the fusible element 14 and the wire 16 to the upper terminal 12 is made by crimping or indenting a portion of the terminal 12 and thereafter welding, soldering, or brazing the element 14 and the wire 16 to the terminal 12 as indicated by the solder bead 15. Likewise, connection of the element 14 and wire 16 to the cable 18 occurs by first compressing a portion of the cable 18 to form a flattened surface 19' thereupon. The element 14 and wire 16 are thereafter welded, soldered, or brazed to the surface 19' of the cable 18 as indicated by the bead 15.

The assembly 10 and its method of manufacture according to the present invention eliminate the connector 26, such as depicted in the prior art fuse assembly 10' of FIG. 2, and the welding, soldering, or brazing operations of the assembly 10'' of FIG. 3 (indicated by the bead 15) while at the same time affording a lower resistance connection than found in either fuse link 10' or 10''. Specifically, the present invention provides for direct mechanical joining of the fusible element 14 and the strain wire 16 to the multi-strand cable 18. The fuse link 10' has two interfaces—14,16/26*a* and 18/26*b*—through which current must pass. The fuse link 10'' eliminates one interface, but has present an interface 14,16/18 which relies on the quality of a possibly unpredictable welding, soldering or brazing operation for low resistance. The direct mechanical joining of the fusible element 14 and the strain wire 16 to the cable 18, according to this invention, ensures a low resistance interface 14,16/18.

According to the present invention, the multi-strand cable 18, prior to its direct attachment to the fusible element 14 and the strain wire 16, is subjected to radially directed compression, such as by a cold-forming operation, to form a receiving region, or pocket indentation 40, therein. Placement of an end of the element 14 and the wire 16 in the receiving region 40 followed by deformation of the sleeve 20 around the receiving region 40 assures rigid electrical connection of the element 14 and the wire 16 to the cable 18.

Referring now to FIGS. 4 and 5, a terminal portion of cable 18, after initial compression is shown. In the initial compression, or cold-forming, operation, an end or segment 37 of the cable 18 is placed in a female die (not shown) of predetermined configuration and the cable segment 37 is thereafter subjected to a radial force of sufficient magnitude to reduce the cross-sectional dimension of the end 37, the cable 18, thereby producing a decreased diameter portion 38. Although the exact diamentral dimension of the portion 38 is not important to the functioning of the fuse link 10, it is preferred that the cross-sectional area of the portion 38 be less than the sum of the cross-sectional areas of the individual strands of the multi-strand cable 18 to assure that the portion 38 be of sufficient size to permit the formation of a receiving region or pocket indentation 40 therein. As one skilled in the art of cold-forming will appreciate, the compression, or cold-forming, operation acts to mechanically bond the individual strands of the multi-strand cable 18 in a close and intimate proximate relation and causes the segment 37 to be relatively inflexible or semi-rigid when compared to the remainder of the cable 18.

Concurrently with the above-described cold-forming operation, a male member (not shown) may be pressed into or rolled along the surface of the segment 37 to form the receiving region 40. In an alternative embodiment, the male member (not shown) may be pressed into or rolled along the surface of the segment 37 after the cold-forming operation in order to form the receiving region 40. In either situation, however, it is preferred that the region 40 be sized sufficiently to permit the insertion or "laying in" of the fusible element 14 and the strain wire 16. The male member (not shown) used to form the receiving region 40 may be of any convenient shape which is pushed into or rolled along the segment 37 of the diametrically decreased portion 38.

After the region 40 is formed in the diametrally decreased portion 38 of the cable 18, ends of the fusible element 14 and strain wire 16 are placed therein, as depicted in FIG. 6*a*. The sleeve 20 is placed around the portion 38 as depicted in FIG. 6*a*. Thereafter, radially directed crimping pressure is applied to the sleeve 20, with the pressure being of sufficient magnitude to crimp the sleeve 20, and collapse the region 50 around the ends of the element 14 and the strain wire 16 within the sleeve 20, directly to the cable 18. The result of this operation is shown in FIG. 6*b*. The sleeve 20 may initially comprise a split or "C" member (not shown), but in this event, must be sufficiently robust to prevent the "C" from opening up after it is crimped to the cable portion 38.

In one embodiment of the present invention the crimping pressure applied to the sleeve 20 is applied in a radially directed, substantially circumferentially uniform manner. In this instance, it is preferred that the sleeve 20 have a generally circular cross-section. In a preferred embodiment, the radially directed crimping pressure is applied in a substantially uniform manner at predetermined circumferential locations on the collar 20. In this instance, the collar 20 has a generally polygonal cross-section such as, for example, hexagonal as depicted in FIG. 1.

As will be apparent, the method of the present invention eliminates the need for the connector 26 as shown in typical prior art fuse link assembly 10' of FIG. 2, as well as the welding, soldering, or brazing operations and the beads 15 of FIG. 3. This reduces production costs while maintaining the securely bonded strain wire 16 and the fusible element 14 in electrical and mechanical connection to the cable 18. Further, upon operation of the cutout 102, there is no relatively massive connector 26 exiting the tube 100; this ensures rapid movement of the terminal 19 and eliminates the possibility of the connector 26 becoming a projectile. Further, as noted above, the fuse link 10 has the fewest possible, reliable current flow interfaces, as compared to the fuse links 10' and 10''.

While the present invention has been described with reference to certain embodiments, the invention is not to be deemed limited thereby. Accordingly, modifications and changes to the foregoing may be made while still falling within the intent and scope of the present invention.

We claim:

1. An improved method of manufacturing a fuse link in which one end of a fusible element is attached to a flexible cable, the improvement comprising:

(a) subjecting a segment of an electrically conducting, multi-strand cable to radial force to compress the cable segment and to form a receiving region within the compressed cable segment;

(b) placing within the receiving region an end of the fusible element to form a fuse link sub-assembly; and (c) subjecting the fuse link sub-assembly to additional radial force to further compress the cable segment and to collapse the receiving region so that the fusible element is electrically and mechanically attached to the cable segment.

2. The method of claim 1, wherein step (c) comprises:

placing a member about the subassembly to encompass the cable segment, the receiving region and the end of the fusible element, and then subjecting the member to radial force to crimp the sleeve onto the cable segment.

3. The method of claim 2, wherein the member is a sleeve

4. The method of claim 1, 2 or 3 wherein step (a) comprises:

pressing a die into said compressed cable segment along the longitudinal axis thereof.

5. The method of claim 2, wherein:

the cross-sectional shape of the sleeve following step (c) is polygonal.

6. The method of claim 2, wherein:

the cross-sectional shape of the sleeve following step (c) is generally circular.

7. An improved method of manufacturing a fuse link in which one end of a fusible element is attached to one end of a flexible cable, the improvement comprising:

(a) subjecting an end segment of an electrically conducting, multi-strand cable to radial force to compress the cable segment and to form a pocket-like receiving region within the compressed segment;

(b) inserting into the receiving region an end of the fusible element to form a first sub-assembly;

(c) positioning a sleeve around the receiving region of the first sub-assembly to form a second sub-assembly; and (d) subjecting the second sub-assembly to radial force to crimp the sleeve to further compress the cable segment and to collapse the receiving region so that the fusible element is electrically and mechanically attached to the cable segment within the sleeve.

8. The method of claim 7, wherein step (d) is effected by applying substantially uniform force around the circumference of the sleeve.

9. The method of claim 7 wherein step (d) is effected by applying force at predetermined locations on the perimeter of the sleeve.

10. An improved fuse link of the type wherein an end of a fusible element is attached to an end of a flexible multi-strand cable, wherein the improvement comprises:

(a) an end segment of the cable subjected to sufficient compressive force to cold-form the strands thereof into a compact, relatively inflexible mass of decreased cross-sectional area, and (b) a receiving region formed in the segment, into which the end of the fusible element is placed, the receiving region being collapsed by compressive force to mechanically and electrically attach the end of the fusible element to the cable.

11. The fuse link of claim 10, which further comprises a member surrounding and crimped onto the segment, the crimped member maintaining the receiving region collapsed.

12. The fuse link of claim 11, wherein the member is a sleeve.

13. The fuse link of claim 12, wherein the crimped sleeve is circular in cross-section.

14. The fuse link of claim 12, wherein the crimped sleeve is polygonal in cross-section.

15. An improved fuse link of the type wherein an end of a fusible element is attached to an end of a flexible multi-strand cable, wherein the improvement comprises:

(a) a segment of the end of the cable subjected to sufficient radial compressive force to cold-form and mechanically bond the strands thereof into a compact, relatively inflexible mass of decreased cross-sectional area which is less than the sum of the cross-sectional areas of the strands prior to application of the compressive force, and (b) a pocket-like receiving region formed in the segment into which receiving region the end of the fusible element is placed, the receiving region being collapsed by compressive force to mechanically and electrically attach the end of the fusible element to the cable.

16. An improved fuse link as set forth in claim 10 or 15, which further comprises:

a fusible strain wire, an end of the strain wire being placed into the receiving region along with the end of the fusible element, the collapse of the receiving region mechanically and electrically attaching the ends of the fusible element and the fusible strain wire to the cable.

* * * * *